US010966480B1

(12) United States Patent
Liu

(10) Patent No.: US 10,966,480 B1
(45) Date of Patent: Apr. 6, 2021

(54) SAFETY HELMET WITH BALL-TYPE ANTI-LATERAL IMPACT PROTECTION

(71) Applicant: Yen-Chao Liu, Tainan (TW)

(72) Inventor: Yen-Chao Liu, Tainan (TW)

( * ) Notice: Subject to any disclaimer, the term of this patent is extended or adjusted under 35 U.S.C. 154(b) by 80 days.

(21) Appl. No.: 16/589,572

(22) Filed: Oct. 1, 2019

(51) Int. Cl.
*A42B 3/06* (2006.01)
*A42B 3/14* (2006.01)
*A42B 3/12* (2006.01)

(52) U.S. Cl.
CPC ..... *A42B 3/14* (2013.01); *A42B 3/12* (2013.01); *A42B 3/06* (2013.01)

(58) Field of Classification Search
CPC .. A42B 3/064; A42B 3/14; A42B 3/12; A42B 3/06; A41D 13/015
See application file for complete search history.

(56) References Cited

FOREIGN PATENT DOCUMENTS

CN 105686192 A 6/2016
CN 108771298 A 11/2018

*Primary Examiner* — Tajash D Patel
(74) *Attorney, Agent, or Firm* — Thomas | Horstemeyer, LLP

(57) ABSTRACT

The safety helmet with a ball-type anti-lateral impact protection has an outer protective body, an inner liner, an activity gap, at least one elastic ball, at least one retaining element, and at least one elastic recovery traction member. The activity gap is formed between the outer protective body and the inner liner. The at least one elastic ball is rollably disposed between the outer protective body and the inner liner. The at least one retaining element holds the at least one elastic ball. The at least one elastic recovery traction member is connected to an outer end portion of the outer protective body and an inner end portion of the inner liner. The at least one elastic ball is freely and rollably connected to the outer protective body and the inner liner for reducing an impact force and improving the anti-lateral impact protection performance.

20 Claims, 13 Drawing Sheets

SAFETY HELMET WITH BALL-TYPE ANTI-LATERAL IMPACT PROTECTION

BACKGROUND OF THE INVENTION

1. Field of the Invention

The present invention relates to a safety helmet, and more particularly to a safety helmet with a ball-type anti-lateral impact protection that has protective effects against anti-linear impact and anti-lateral impact.

2. Description of Related Art

A safety helmet is used to protect a head of a user. A conventional safety helmet has a shell and a liner. The shell is made of a single material or composite plastic material that is rigid and not prone to break. The liner is disposed on an inner surface of the shell and has a cushioning effect for protecting the head of the user.

However, types of impact that the user's head is subjected to, as known in recent years, are roughly classified into three types, such as linear impact, lateral impact (or rotating impact), and low-speed continuous impact. The low-speed continuous impact includes the linear impact and the lateral impact (or rotating impact). In the conventional safety helmet, the liner is fixed on the inner surface of the shell. The conventional safety helmet only has the anti-linear impact protection function, and does not have the anti-lateral impact protection function.

For overcoming the problem that the conventional safety helmet does not have the anti-lateral impact protection function, a safety helmet further has multiple liners and multiple damper structures. A damper structure layer is composed of the damper structures. The damper structure layer is inserted between the shell and the adjacent liner, or between two adjacent liners. Two ends of the damper structure layer, the shell and the liner, or the two adjacent liners can be moved relative to each other within a limited range by the damper structures, so that the safety helmet having the damper structure has the anti-lateral impact protection function.

However, the safety helmet is based on the design requirements of the product. The thickness of the shell, the thickness of the liner, and the gap for inserting the damper structure layer between the shell and the adjacent liner have certain size limitations. The deformation capacities of the damper structure are limited. Moreover, two ends of each one of the damper structure are respectively coupled to the shell and the liner or the adjacent liners, and a distance between the shell and the liner or a distance between the adjacent liners is fixed and restricted within the moving stroke formed between the shell and the liner or a distance between the adjacent liners. The smoothness of the relative movement of the liner and the shell is restricted by the deformations of the damper structure. The anti-lateral impact protection performance is limited.

To overcome the shortcomings, the present invention provides a safety helmet with ball-type anti-lateral impact protection to mitigate or obviate the aforementioned problems.

SUMMARY OF THE INVENTION

The objective of the invention is to provide a safety helmet with ball-type anti-lateral impact protection that can improve the anti-impact protection of the safety helmet, especially the anti-lateral impact protection performance of the safety helmet.

The safety helmet with ball-type anti-lateral impact protection has an outer protective body, an inner liner, an activity gap, at least one elastic ball, at least one retaining element, and at least one elastic recovery traction member.

The outer protective body has a bottom surface, a chamber, a combining surface, and an outer end portion. The chamber is formed in the bottom surface of the outer protective body. The combining surface is formed on the outer protective body around the chamber of the outer protective body. The outer end portion is formed on the bottom surface of the outer protective body around the chamber of the outer protective body.

The inner liner is moveably disposed on the outer protective body, is located in the chamber of the outer protective body, and has a bottom surface, a connecting surface, and an inner end portion. The connecting surface is formed on the inner liner and faces the combining surface of the outer protective body. The inner end portion is formed on the bottom surface of the inner liner.

The activity gap is formed between the combining surface of the outer protective body and the connecting surface of the inner liner.

The at least one elastic ball is disposed between the outer protective body and the inner liner and is rollably connected to the outer protective body and the inner liner.

The at least one retaining element is selectively disposed on one of the outer protective body and the inner liner and holds the at least one elastic ball.

The at least one elastic recovery traction member is connected to the outer end portion of the outer protective body and the inner end portion of the inner liner.

The safety helmet in accordance with the present invention has the following advantages.

1. Improving the impact protection performance: the at least one elastic ball is rollably disposed between the outer protective body and the inner liner. The at least one elastic recovery traction member is connected to the outer end portion of the outer protective body and the inner end portion of the inner liner for providing an elasticity to recover the outer protective body and the inner liner. When the safety helmet is impacted by an external force, the at least one elastic ball can be deformed to absorb and bounce the external force for decreasing the impact force, such as linear impact force, non-linear impact force, and low-speed continuous impact force. In addition, the inner liner and the outer protective body can provide the cushioning function. Therefore, the impact protection performance of the safety helmet is good.

2. Good anti-lateral impact protection performance: as abovementioned, the at least one elastic ball is freely and rollably connected to the outer protective body and the inner liner, so that the inner liner can omnidirectionally move relative to the outer protective body for increasing a relative movement distance between the inner liner and the outer protective body. The anti-lateral impact protection performance of the safety helmet is good.

3. Smooth relative movement: as above, the at least one elastic ball is freely and rollably connected to the outer protective body and the inner liner. The inner liner can omnidirectionally move relative to the outer protective body for increasing the relative movement distance between the inner liner and the outer protective body. The at least one elastic ball is in point contact with the outer protective body or the inner liner. During a relative movement between the outer protective body and the inner liner, the omnidirectional interference is decreased, and the frictional resistance is decreased, too. Therefore, the relative movement between the outer protective body and the inner liner is smooth, so that the anti-lateral impact protection performance of the safety helmet is good.

Furthermore, the at least one retaining element is disposed on the outer protective body or the inner liner for increasing a contacting strength of the outer protective body or a contacting strength of the inner liner. In addition, the at least one retaining element holds the at least one elastic ball for preventing the at least one elastic ball from escaping out of the at least one retaining element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
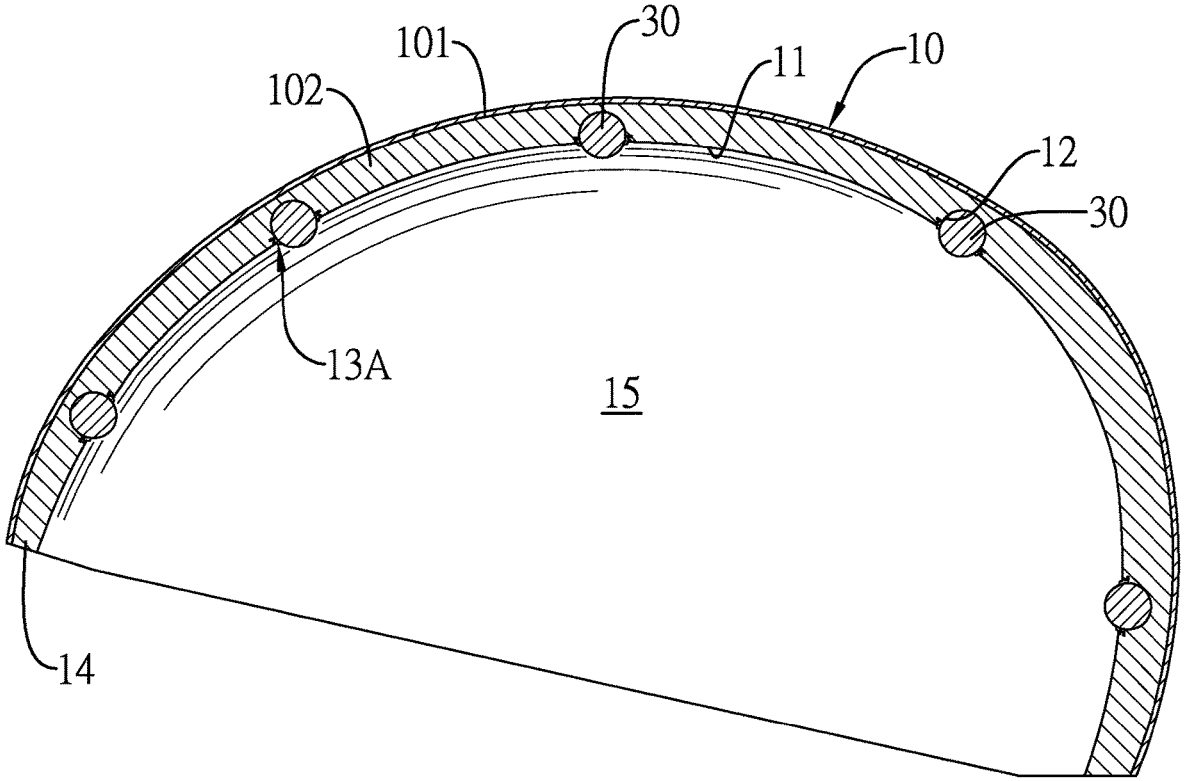
FIG. 1 is a cross sectional side view of an outer protective body of a first embodiment of a safety helmet with a ball-type anti-lateral impact protection in accordance with the present invention.
Figure 2:
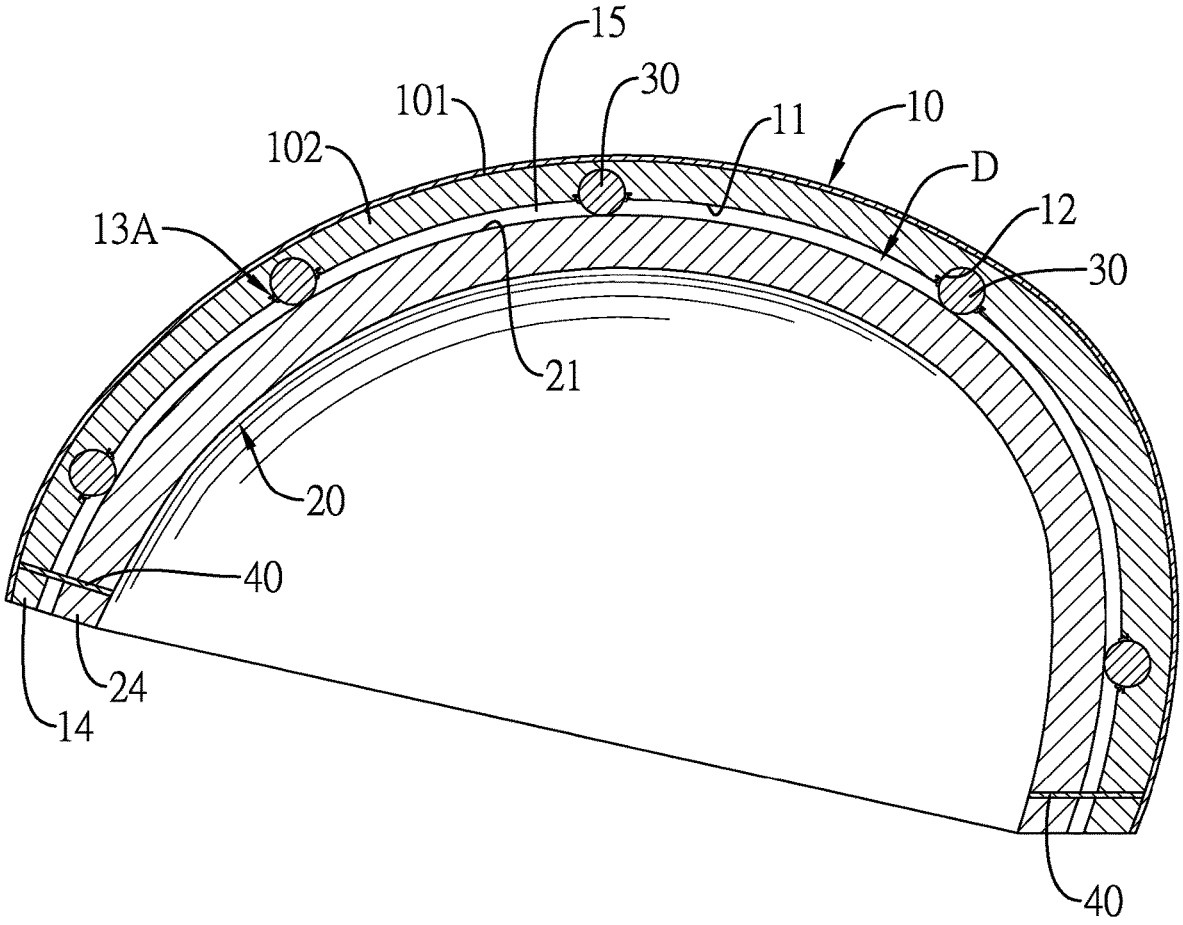
FIG. 2 is a cross sectional side view of the first embodiment of the safety helmet in FIG. 1.
Figure 3:
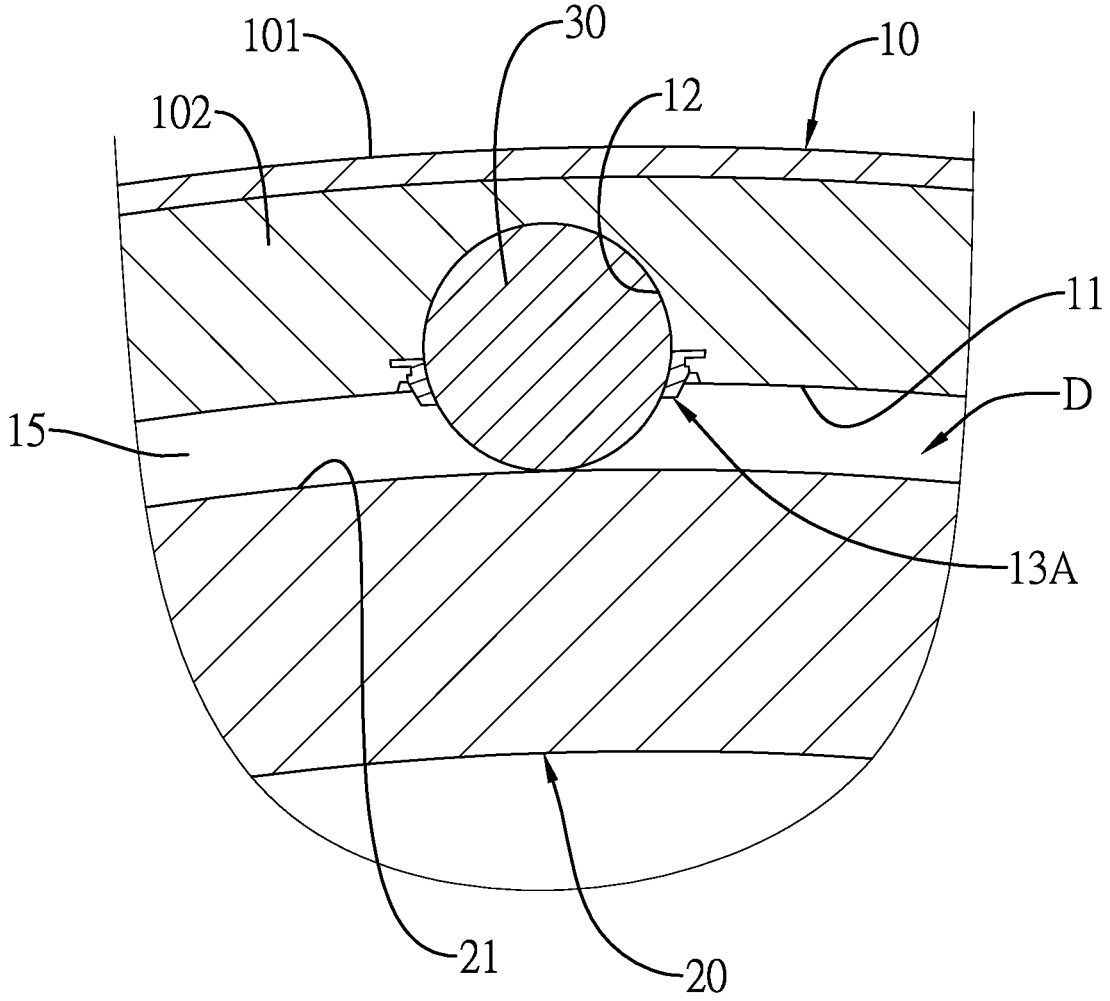
FIG. 3 is an enlarged side view of the safety helmet in FIG. 2.

With reference to FIGS. 1 to 10, multiple embodiments of a safety helmet with ball-type anti-lateral impact protection may be a helmet used by a motorcyclist, a helmet used by an athlete, or a helmet used by an engineer, etc. The safety helmet may be a full-face helmet, a semi-cover helmet, or a three-quarter helmet, etc. For facilitating conciseness in the description of the safety helmet in accordance with the present invention, the embodiments disclosed in the drawings show the semi-cover helmet. The type of the safety helmet with a ball-type anti-lateral impact protection is not limited to that disclosed in the drawings.

With reference to FIGS. 1 to 10, the safety helmet with ball-type anti-lateral impact protection has an outer protective body 10, an inner liner 20, an activity gap D, at least one elastic ball 30, at least one retaining element 13A, 13B, 23A, 23B and at least one elastic recovery traction member 40.

With reference to FIGS. 1 to 9, the outer protective body 10 is a cambered body, can cover a head of a user, and has a bottom surface, a chamber 15, a combining surface 11, and an outer end portion 14. The chamber 15 is formed in the bottom surface of the outer protective body 10. The combining surface 11 is formed on the outer protective body 10 around the chamber 15 of the outer protective body 10. The outer end portion 14 is formed on the bottom surface of the outer protective body 10 around the chamber 15 of the outer protective body 10. The combining surface 11 is a concave surface. The outer protective body 10 may be a shell 101, a cushioning liner made of a single cushioning material, or a cushioning liner made of multiple cushioning materials. Furthermore, the outer protective body 10 has a composite structure including the shell 101 and an outer liner 102 fixedly disposed on the shell 101. The outer liner 102 can be a single component or a combination of multiple components. The structure of the outer protective body 10 is not limited to the above-described outer protective body 10. The materials of the inner liner 20 and the outer liner 102 may be, but are not limited to, expandable polystyrene (EPS), expanded polypropylene (EPP), expandable Polystyrene Copolymer (EPO), and other cushioning materials. The selections and the arrangements of the inner liner 20 and the outer liner 102 depend on the structural requirement of the product.

The inner liner 20 is a cambered body, can cover the head of the user, is moveably disposed on the outer protective body 10, is located in the chamber 15 of the outer protective body 10, and has a bottom surface, a connecting surface 21, and an inner end portion 24. The connecting surface 21 is formed on the inner liner 20 and faces the combining surface 11 of the outer protective body 10. The inner end portion 24 is formed on the bottom surface of the inner liner 20. The connecting surface 21 is a convex surface. The connecting surface 21 and the combining surface 11 are substantially complementary in shape.

The activity gap D is formed between the combining surface 11 of the outer protective body 10 and the connecting surface 21 of the inner liner 20.

The number of the at least one elastic ball 30 may be one or more and is determined by the needs of the product. The at least one elastic ball 30 is disposed between the outer protective body 10 and the inner liner 20, and is freely and rollably connected to the combining surface 11 of the outer protective body 10 and/or the connecting surface 21 of the inner liner 20. When the number of the at least one elastic ball 30 is plural, the plurality of the elastic balls 30 are disposed between an inner side of the outer protective body 10 and an outer side of the inner liner 20.

The at least one retaining element 13A, 13B, 23A, 23B is selectively disposed on one of the outer protective body 10 and the inner liner 20 and holds the at least one elastic ball 30 for increasing a contacting strength of the outer protective body 10 or a contacting strength of the inner liner 20 and preventing the at least one elastic ball 30 from escaping out of the at least one retaining element 13A, 13B, 23A, 23B.

The combining surface 11 of the outer protective body 10 and the connecting surface 21 of the inner liner 20 can be disposed with plastic films by hot pressing means or pasting means. The plastic films are located at a rolling-contacting active region for decreasing the frictional resistance between the at least one elastic ball 30 and the combining surface 11 of the outer protective body 10, and for decreasing the frictional resistance between the at least one elastic ball 30 and the connecting surface 21 of the inner liner 20.

The at least one elastic ball 30 can be selected from a known elastic material having absorbing and bouncing functions and can disperse the lateral impact and the continuous impact by changing the direction of the external force by free rolling means. The size and the hardness of the at least one elastic ball 30 are selected and adjusted according to the needs of the product. The size of the activity gap D between the inner liner 20 and the outer protective body 10 can be controlled by the diameter of the at least one elastic ball 30.

With reference to FIGS. 1 to 11, the number of the at least one elastic recovery traction member 40 may be one or more. The at least one elastic recovery traction member 40 is connected to the outer end portion 14 of the outer protective body 10 and the inner end portion 24 of the inner liner 20 for providing a recovering elasticity after a relative movement of the outer protective body 10 and the inner liner 20. The at least one elastic recovery traction member 40 is located out of the rolling-contacting active region, and does not affect the free movement of the at least one elastic ball 30. The at least one elastic recovery traction member 40 is connected to the outer end portion 14 of the outer protective body 10 and the inner end portion 24 of the inner liner 20 by a connecting element, such as buckle, hook, or rivet.

Figure 11:
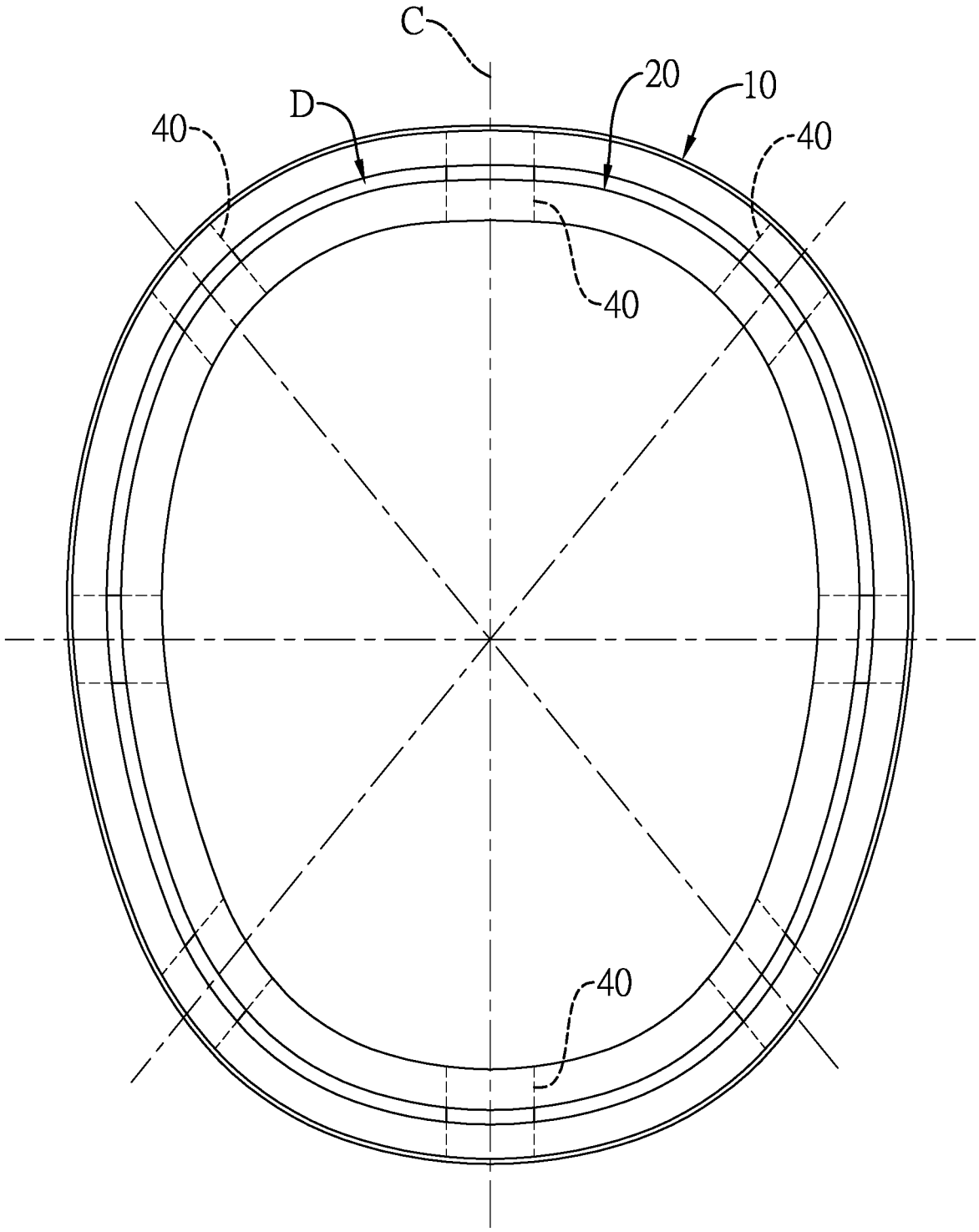
FIG. 11 is a bottom view of the safety helmet in FIGS. 2 and 4.

When the number of the at least one elastic recovery traction member 40 is one, the elastic recovery traction member 40 can be selected from an annular belt part and is connected around a bottom end of the inner liner 20 and a bottom end of the outer protective body 10. With reference to FIG. 11, the number of the at least one elastic recovery traction member 40 is plural. The plurality of the elastic recovery traction members 40 are symmetrically arranged with respect to a central line C of the inner liner 20 for balancing the outer protective body 10 and the inner liner 20. The central line C of the inner liner 20 is defined on the inner liner 20 and extends from a front end of the inner liner 20 to a rear end of the inner liner 20.

The differences between the embodiments of the safety helmet with ball-type anti-lateral impact protection are described as follows.

Figure 4:
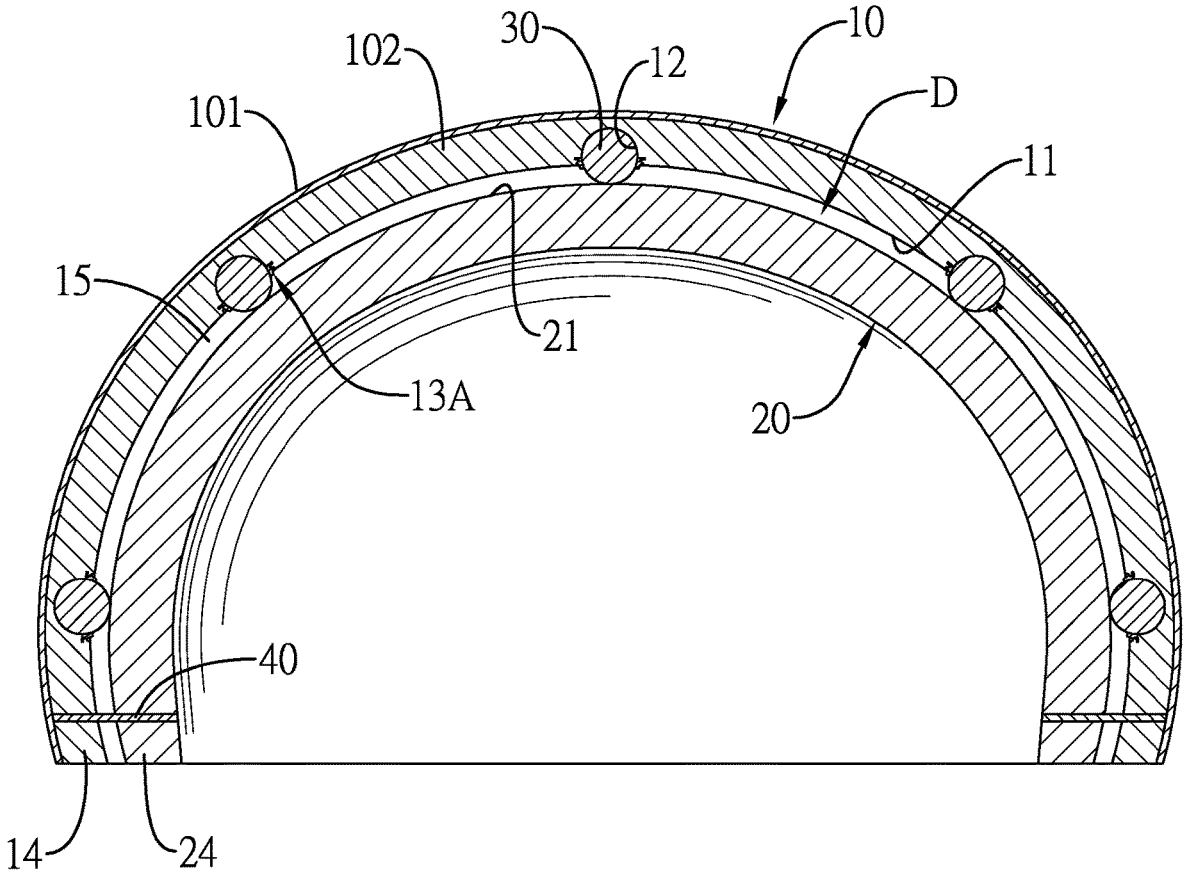
FIG. 4 is a cross sectional front side view of the safety helmet in FIG. 2.

With reference to FIGS. 1 and 4, in a first embodiment of the safety helmet, the outer protective body 10 has the shell 101 and the outer liner 102. The outer liner 102 is fixedly disposed on the shell 101 and faces the inner liner 20. The safety helmet has multiple ball sockets 12 formed in the combining surface 11. The combining surface 11 is formed on the outer liner 102. Each one of the at least one elastic ball 30 is rollably and freely disposed in a corresponding one of the ball sockets 12, and is rollably and freely connected to the connecting surface 21 of the inner liner 20. The number of the at least one retaining element 13A is plural, and each retaining element 13A is a ring, is disposed on the outer liner 102, and faces the activity gap D.

Figure 5:
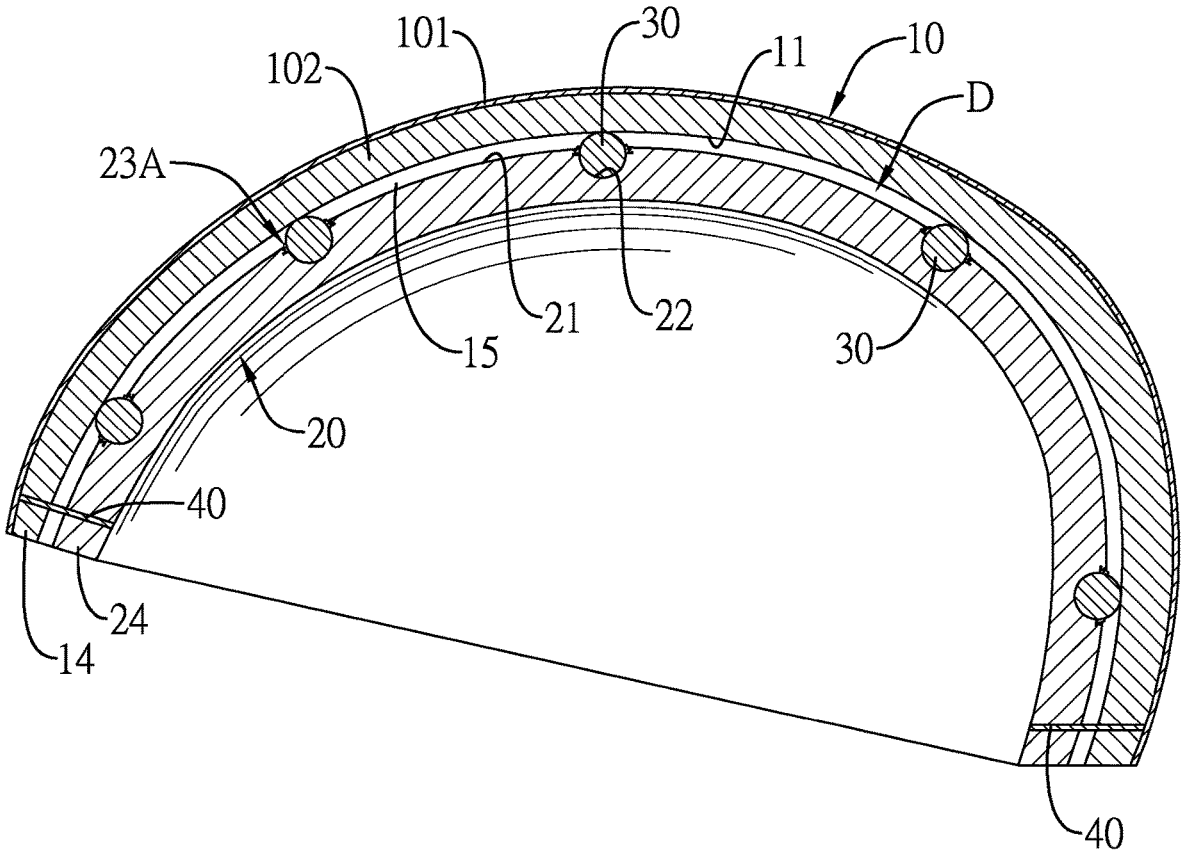
FIG. 5 is a cross sectional side view of a second embodiment of a safety helmet with a ball-type anti-lateral impact protection in accordance with the present invention.

With reference to FIG. 5, in a second embodiment of the safety helmet, the outer protective body 10 has the shell 101 and the outer liner 102 fixedly disposed on the shell 101. The safety helmet has multiple ball sockets 12 formed in the connecting surface 21 of the inner liner 20. The combining surface 11 is formed on the outer liner 102 and faces the inner liner 20. Each one of the at least one elastic ball 30 is rollably and freely disposed in the corresponding one of the ball sockets 12, and is rollably and freely connected to the combining surface 11 of the outer protective body 10. The number of the at least one retaining element 23A is plural, and each one of the e retaining elements 23A is a ring, is disposed on the connecting surface 21, and faces the activity gap D.

Figure 6:
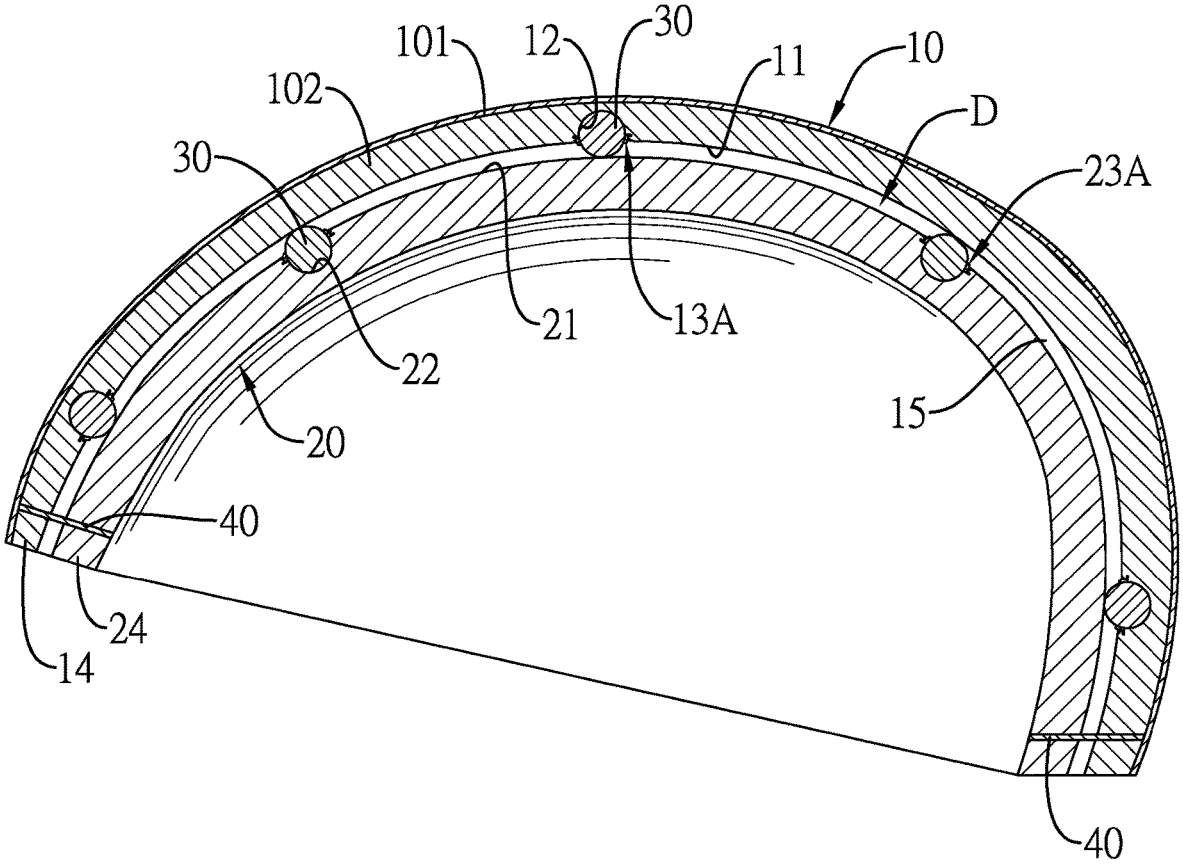
FIG. 6 is a cross sectional side view of a third embodiment of a safety helmet with a ball-type anti-lateral impact protection in accordance with the present invention.

With reference to FIG. 6, in a third embodiment of the safety helmet, the outer protective body 10 has the shell 101 and the outer liner 102 fixedly disposed on the shell 101. The combining surface 11 is formed on the outer liner 102 and faces the inner liner 20. The safety helmet has multiple ball sockets 12 formed in the combining surface 11 of the outer protective body 10 and the connecting surface 21 of the inner liner 20. The ball sockets 12 disposed in the outer protective body 10 and the ball sockets 12 disposed in the inner liner 20 are arranged in an alternate manner. The number of the at least one retaining element 13A, 23A is plural. The plurality of the retaining elements 13A, 23A are respectively disposed on the ball sockets 12. Each elastic ball 30 is rollably disposed in the corresponding one of the ball sockets 12, and is rollably connected to the combining surface 11 of the outer protective body 10 or the connecting surface 21 of the inner liner 20.

Figure 7:
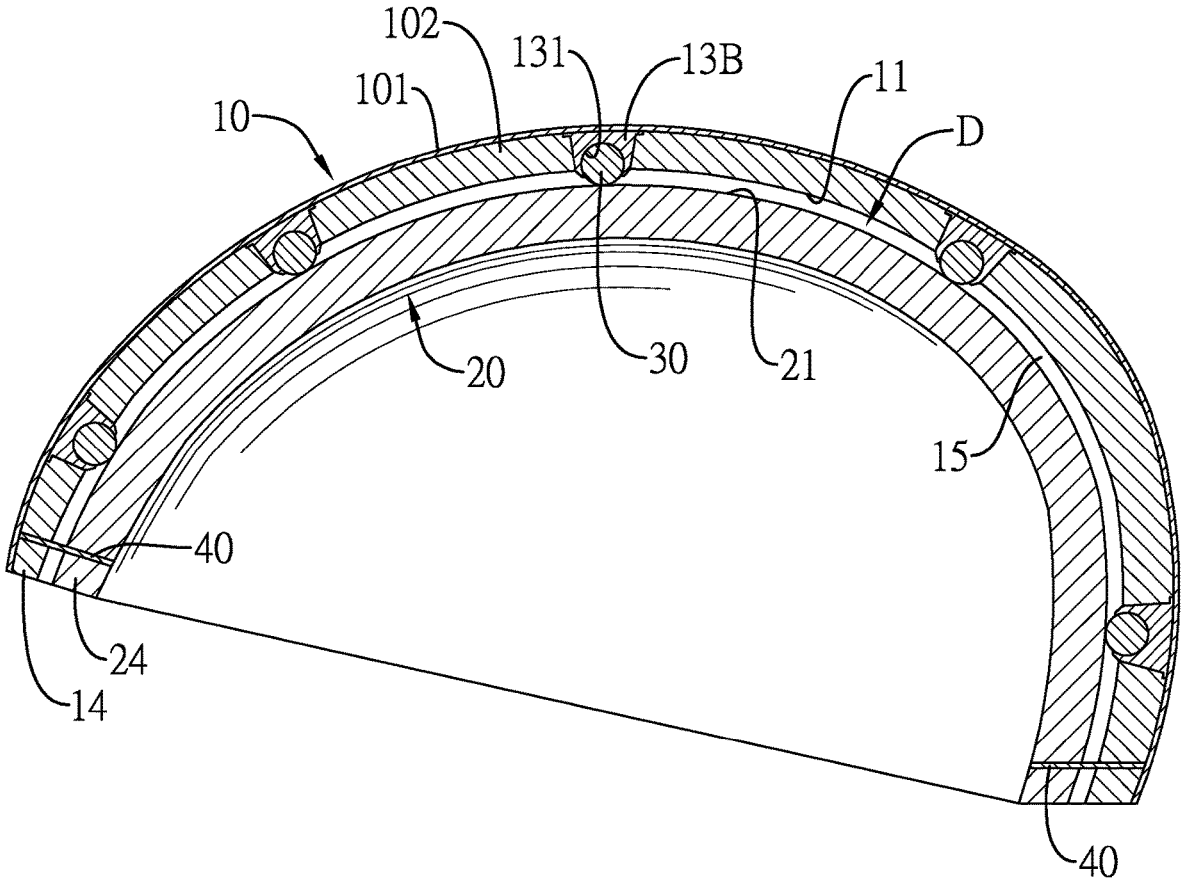
FIG. 7 is a cross sectional side view of a fourth embodiment of a safety helmet with a ball-type anti-lateral impact protection in accordance with the present invention.

With reference to FIG. 7, in a fourth embodiment of the safety helmet, the outer protective body 10 has the shell 101 and the outer liner 102 fixedly disposed on the shell 101. The number of the at least one retaining element 13B is plural. The plurality of retaining elements 13B are disposed in the outer liner 102 at spaced intervals. Each one of the retaining elements 13B is a seat and has a ball socket 131 formed in the at least one retaining element 13B and facing the activity gap D. Each elastic ball 30 is rollably disposed in the ball socket 131 of a corresponding one of the at least one retaining element 13B, and is rollably connected to the connecting surface 21 of the inner liner 20.

Figure 8:
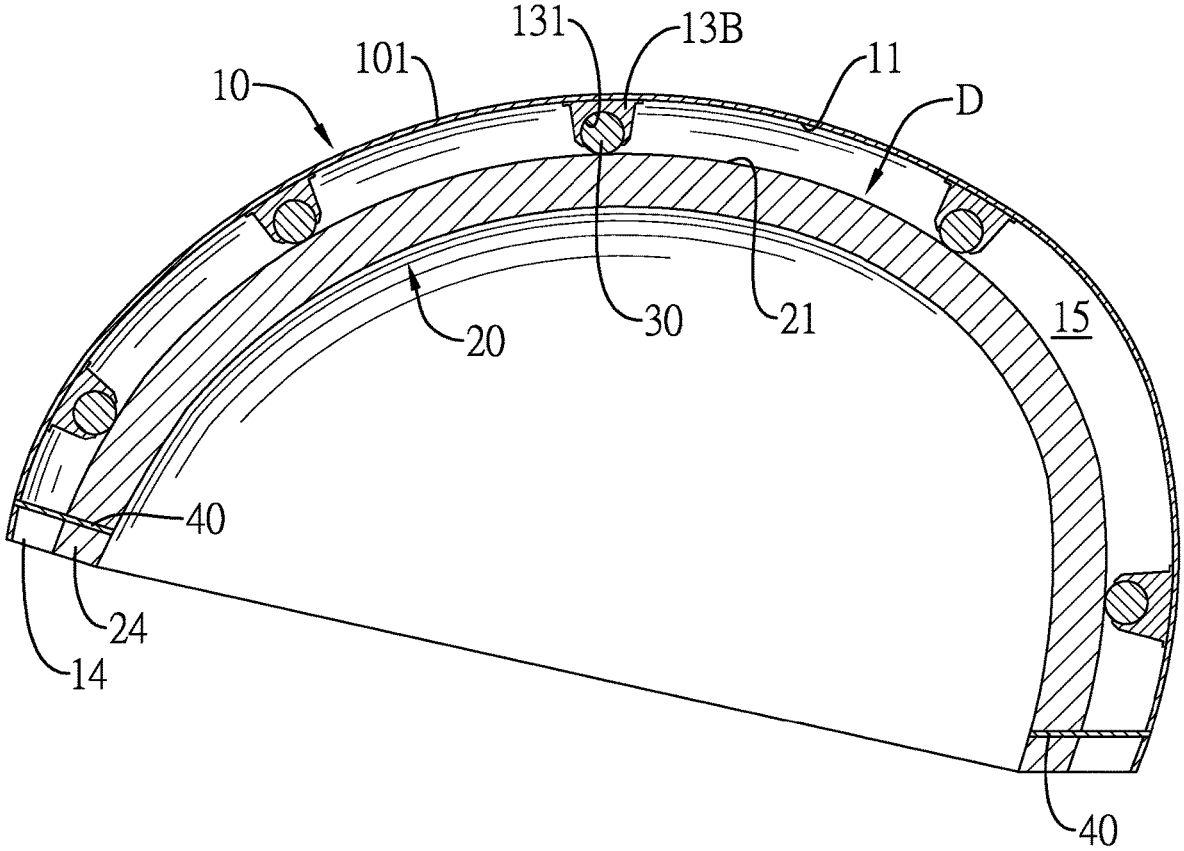
FIG. 8 is a cross sectional side view of a fifth embodiment of a safety helmet with a ball-type anti-lateral impact protection in accordance with the present invention.

With reference to FIG. 8, in a fifth embodiment of the safety helmet, the outer protective body 10 only has the shell 101 without the outer liner 102. The number of the at least one retaining element 13B is plural. The plurality of retaining elements 13B are disposed on the shell 101 at spaced intervals. Each retaining element 13B is a seat and has the ball socket 131 formed in the retaining element 13B and facing the activity gap D. Each one of the at least one elastic ball 30 is rollably disposed in the ball socket 131 of the corresponding one of the retaining elements 13B, and is rollably connected to the connecting surface 21 of the inner liner 20.

Figure 9:
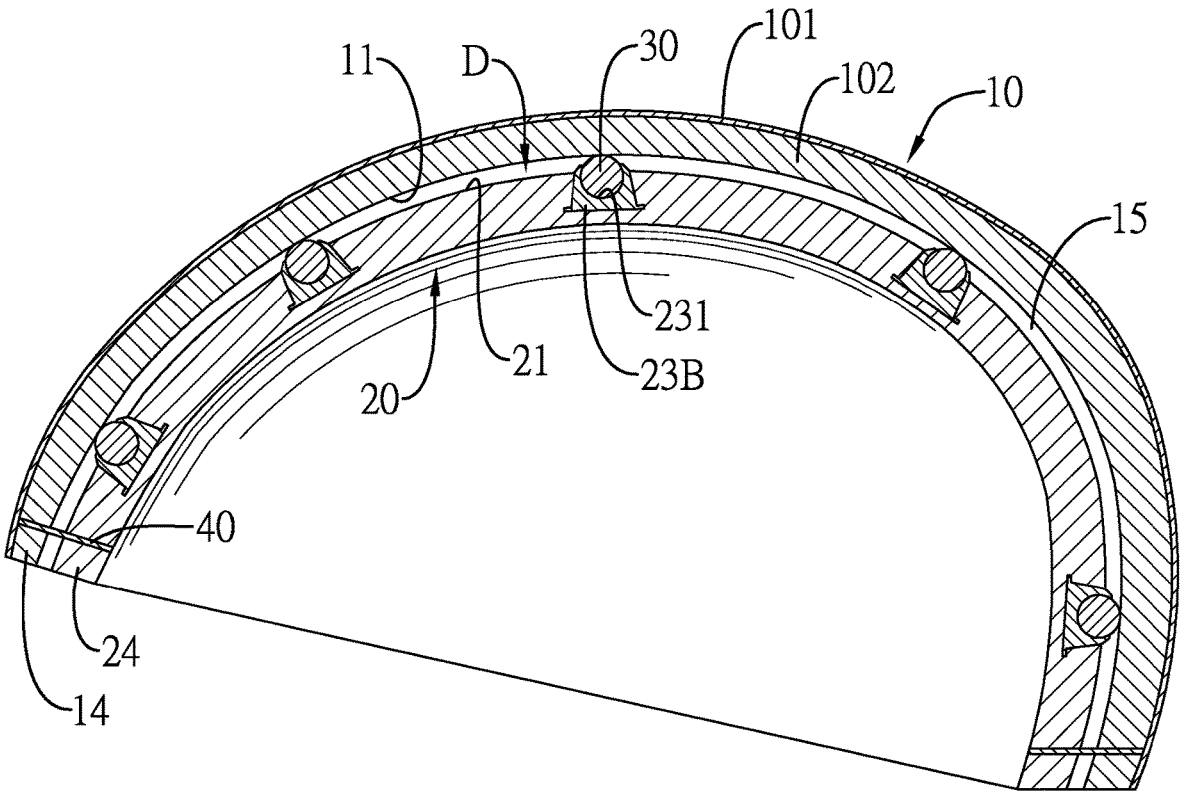
FIG. 9 is a cross sectional side view of a sixth embodiment of a safety helmet with a ball-type anti-lateral impact protection in accordance with the present invention.

With reference to FIG. 9, in a sixth embodiment of the safety helmet, the number of the at least one retaining element 23B is plural. The plurality of retaining elements 23B are disposed on the inner liner 20 at spaced intervals. Each retaining element 23B is a seat and has the ball socket 231 formed in the retaining element 23B and facing the activity gap D. Each elastic ball 30 is rollably disposed in the ball socket 231 of the corresponding one of the retaining elements 23B, and is rollably connected to the combining surface 11 of the outer protective body 10.

Figure 10:
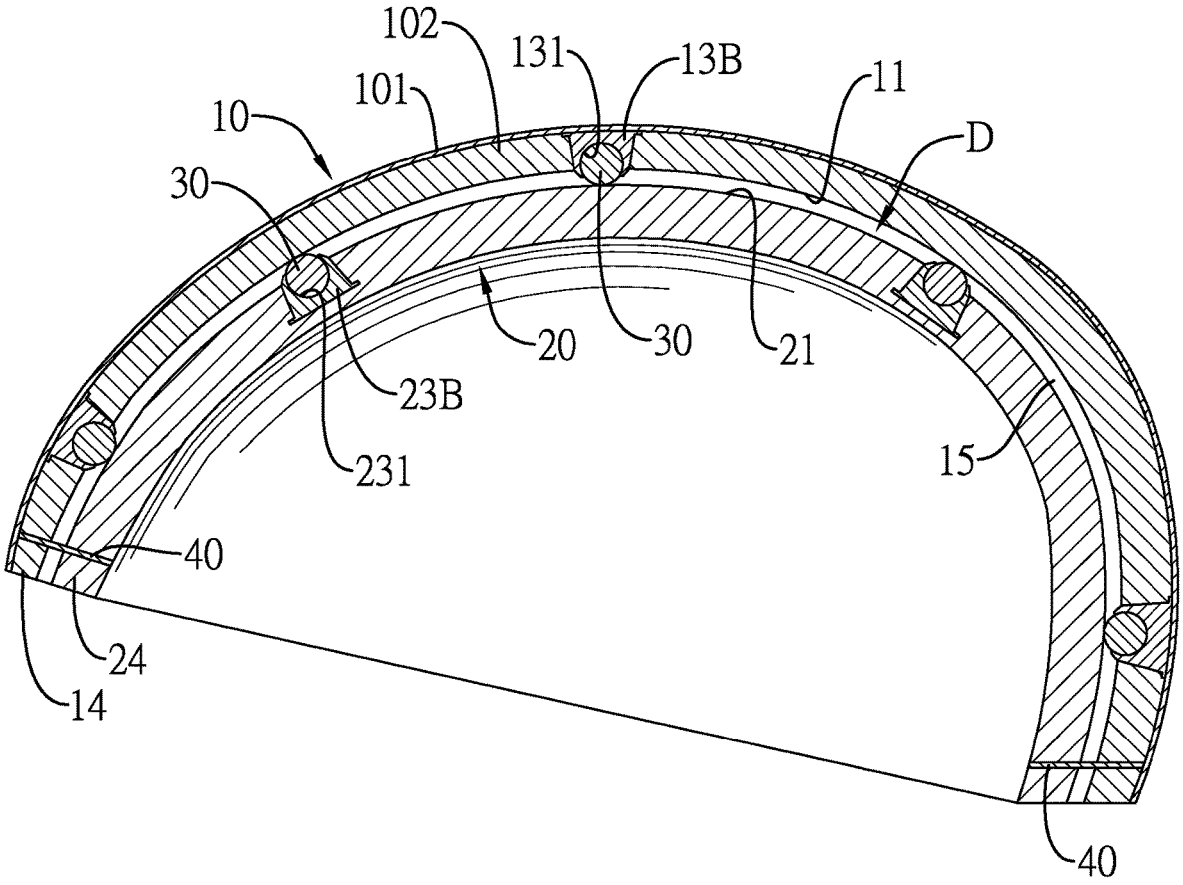
FIG. 10 is a cross sectional side view of a seventh embodiment of a safety helmet with a ball-type anti-lateral impact protection in accordance with the present invention.

With reference to FIG. 10, in a seventh embodiment of the safety helmet, the outer protective body 10 has the shell 101 and the outer liner 102 fixedly disposed on the shell 101. The combining surface 11 is formed on the outer liner 102 and faces the inner liner 20. The number of the at least one retaining element 13B, 23B is plural. Each one of the plurality of retaining elements 13B, 23B is a seat. The outer protective body 10 and the inner liner 20 both have the retaining elements 13B, 23B disposed thereon. The retaining elements 13B disposed on the outer protective body 10 and the retaining elements 23B disposed on the inner liner 20 are arranged in an alternate manner. Each retaining element 13B, 23B has the ball socket 131, 231 formed in the retaining element 13B, 23B and facing the activity gap D. Each elastic ball 30 is rollably disposed in the ball socket 131, 231 of the corresponding one of the retaining elements 13B, 23B, and is rollably connected to the combining surface 11 of the outer protective body 10 or the connecting surface 21 of the inner liner 20.

The retaining elements 13B are disposed on the outer protective body 10 by means of insert molding, screwing, or bonding. Furthermore, the retaining elements 23B are disposed on the inner liner 20 by means of insert molding.

The walls of the ball sockets 131, 231, the combining surface 11 of the outer protective body 10, and the connecting surface 21 of the inner liner 20 all have a contacting layer to contact the at least one elastic ball 30 for increasing rolling lubricity or impact resistance of the at least one elastic ball 30, or decreasing the frictional resistance. The material of the contacting layer can be selected according to the required lubricity, impact resistance, or frictional resistance. The contacting layer can be made of polycarbonate (PC) or polyvinyl chloride (PVC) for good impact resistance.

Figure 12:
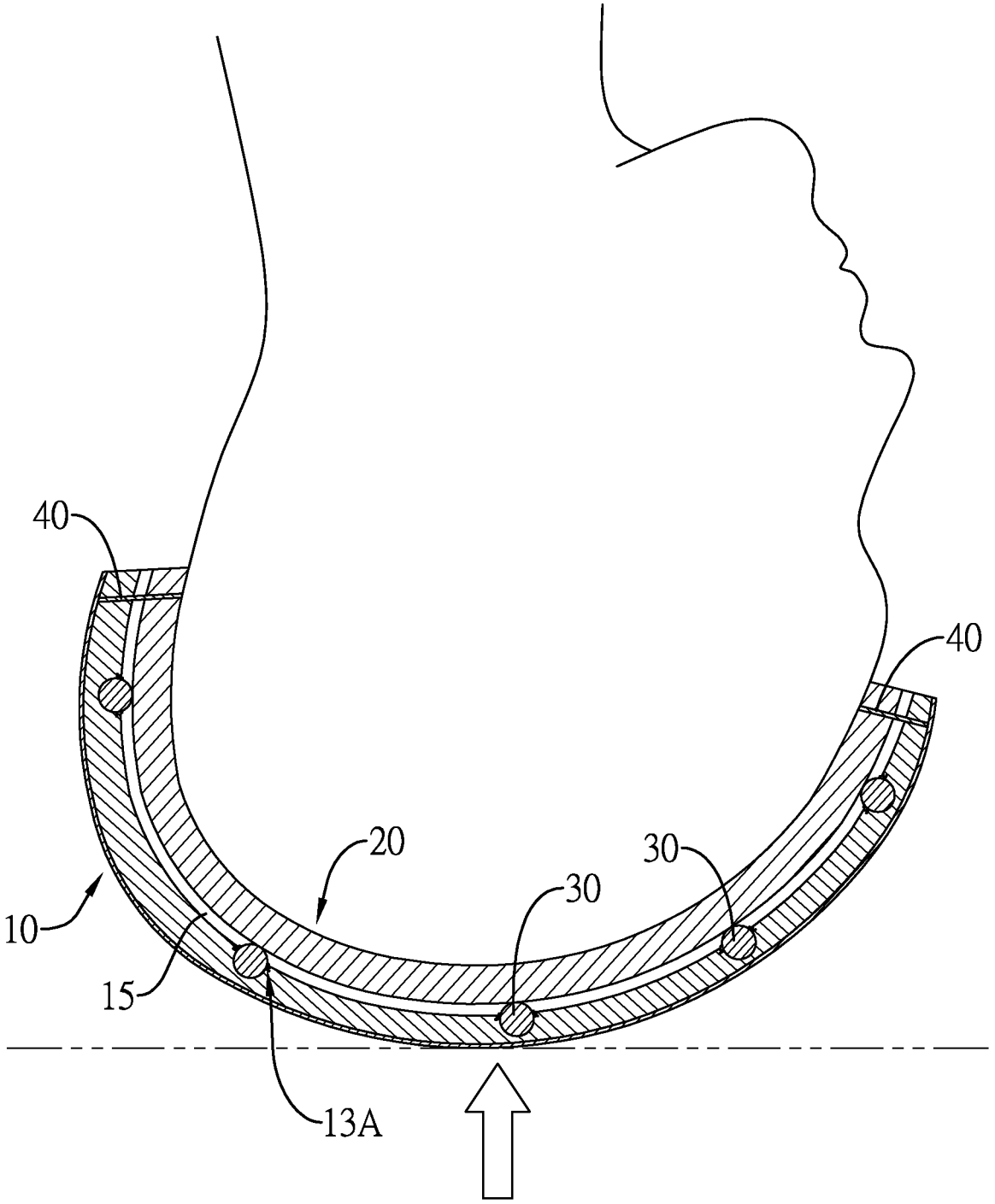
FIG. 12 is an operational side view in partial section of the safety helmet in FIG. 2 showing that the safety helmet is on a linear impact.
Figure 13:
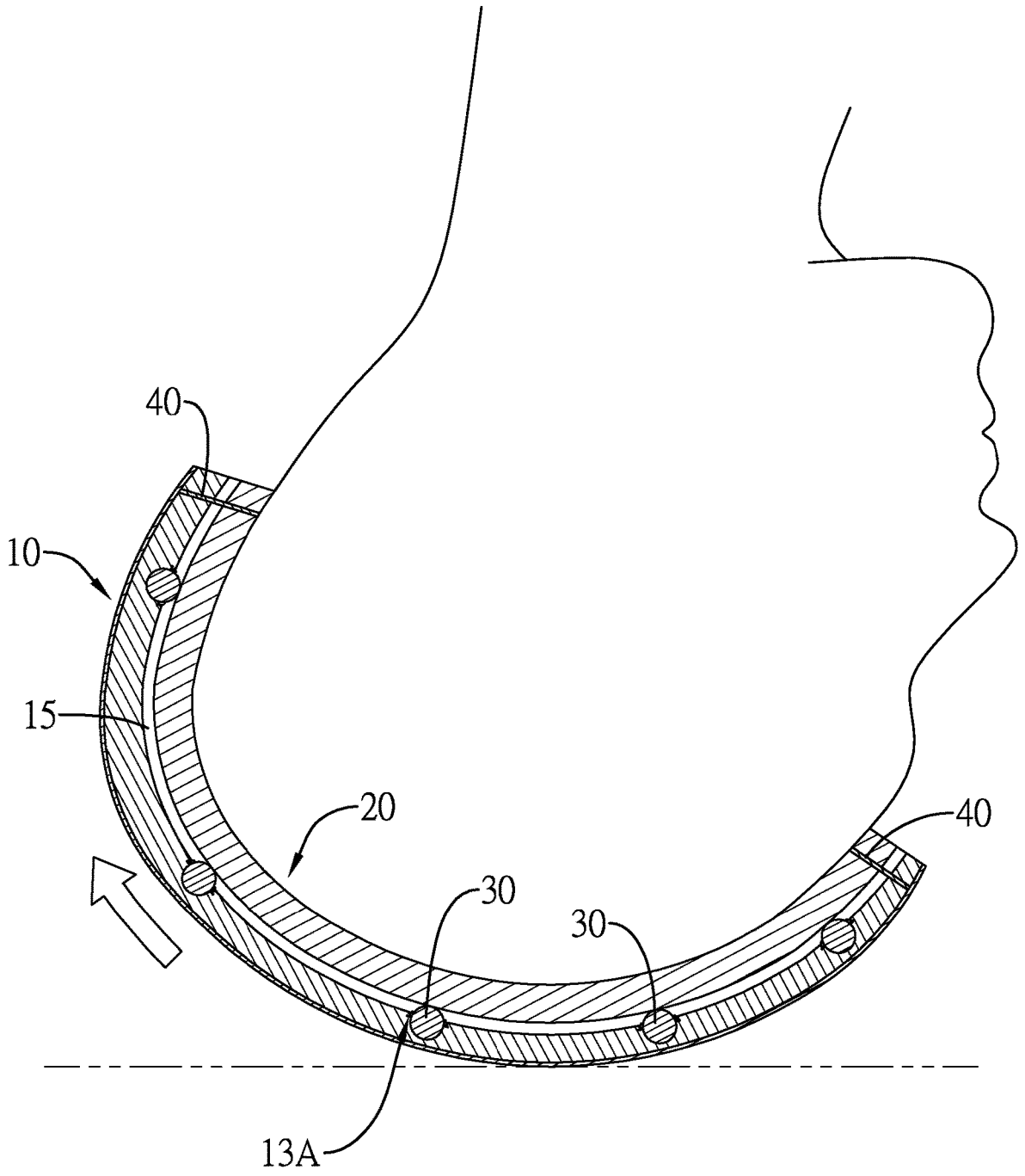
FIG. 13 is another operational side view in partial section of the safety helmet in FIG. 2 showing that the safety helmet is on a lateral impact.

With reference to FIGS. 12 and 13, in use, the safety helmet is worn by the user for protecting the head of the user. The types of the linear impact and the lateral impact in the head impact are described as follows.

The linear impact: when the safety helmet is impacted by a normal force of the linear impact or a normal force component of the low-speed continuous impact, the at least one elastic ball 30 is dispersed to have the absorbing and bouncing functions for reducing the normal force of the linear impact or the normal force component of the low-speed continuous impact. Furthermore, the inner liner 20 and the outer protective body 10 can provide the cushioning function. Therefore, the impact protection performance of the safety helmet is good.

The lateral impact: when the safety helmet is impacted by a lateral force of the lateral impact or a lateral force of the low-speed continuous impact, the inner liner 20 can move relative to the outer protective body 10. The at least one elastic ball 30 is freely and rollably connected to the outer protective body 10 and the inner liner 20. The inner liner 20 can omnidirectionally move relative to the outer protective body 10 for increasing the relative movement distance between the inner liner 20 and the outer protective body 10. The relative movement between the outer protective body 10 and the inner liner 20 is smooth, such that the lateral force of the lateral impact or the lateral force of the low-speed continuous impact can be reduced effectively. The anti-lateral impact protection performance of the safety helmet is good.

Accordingly, the at least one elastic ball 30 is rollably disposed between the outer protective body 10 and the inner liner 20. The at least one elastic recovery traction member 40 is connected to the outer end portion 14 of the outer protective body 10 and the inner end portion 24 of the inner liner 20 for providing an elasticity to recover the outer protective body 10 and the inner liner 20. When the safety helmet is impacted by an external force, the at least one elastic ball 30 can be deformed to absorb and bounce the external force for decreasing the impact force, such as linear impact force, non-linear impact force, and low-speed continuous impact force. In addition, the inner liner 20 and the outer protective body 10 can provide the cushioning function. Therefore, the impact protection performance of the safety helmet is good.

Simultaneously, the at least one elastic ball 30 is freely and rollably connected to the outer protective body 10 and the inner liner 20, so that the inner liner 20 can omnidirectionally move relative to the outer protective body 10 for increasing a relative movement distance between the inner liner 20 and the outer protective body 10. The anti-lateral impact protection performance of the safety helmet is good.

What is claimed is:

1. A safety helmet comprising:

an outer protective body having a bottom surface;

a chamber formed in the bottom surface of the outer protective body;

a combining surface formed on the outer protective body around the chamber of the outer protective body; and an outer end portion formed on the bottom surface of the outer protective body around the chamber of the outer protective body;

an inner liner moveably disposed on the outer protective body, located in the chamber of the outer protective body, and having a bottom surface;

a connecting surface formed on the inner liner and facing the combining surface of the outer protective body; and an inner end portion formed on the bottom surface of the inner liner;

an activity gap formed between the combining surface of the outer protective body and the connecting surface of the inner liner;

at least one elastic ball disposed between and rollably connected to the outer protective body and the inner liner;

at least one retaining element selectively disposed on one of the outer protective body and the inner liner and holding the at least one elastic ball; and at least one elastic recovery traction member connected to the outer end portion of the outer protective body and the inner end portion of the inner liner.

2. The safety helmet as claimed in claim 1, wherein a central line is defined on the inner liner and extends from a front end of the inner liner to a rear end of the inner liner; and the number of the at least one elastic recovery traction member is plural, and the plurality of the elastic recovery traction members are symmetrically arranged with respect to the central line of the inner liner.

3. The safety helmet as claimed in claim 1, wherein the outer protective body or the inner liner has multiple ball sockets facing the activity gap; and the number of the at least one elastic ball is plural, and each one of the elastic balls is rollably disposed in a corresponding one of the ball sockets, and is rollably connected to one of the combining surface of the outer protective body and the connecting surface of the inner liner.

4. The safety helmet as claimed in claim 2, wherein the outer protective body or the inner liner has multiple ball sockets facing the activity gap; and the number of the at least one elastic ball is plural, and each one of the elastic balls is rollably disposed in a corresponding one of the ball sockets, and is rollably connected to one of the combining surface of the outer protective body and the connecting surface of the inner liner.

5. The safety helmet as claimed in claim 3, wherein the outer protective body has a shell and an outer liner, the outer liner is fixedly disposed on the shell and faces the inner liner, and the combining surface and the ball sockets are formed on the outer liner.

6. The safety helmet as claimed in claim 4, wherein the outer protective body has a shell and an outer liner, the outer liner is fixedly disposed on the shell and faces the inner liner, and the combining surface and the ball sockets are formed on the outer liner.

7. The safety helmet as claimed in claim 1, wherein the outer protective body and the inner liner both have multiple ball sockets facing the activity gap, and the ball sockets disposed on the outer protective body and the ball sockets disposed on the inner liner are arranged in an alternate manner; and the number of the at least one elastic ball is plural, and each one of the elastic balls is rollably disposed in a corresponding one of the ball sockets, and is rollably connected to one of the combining surface of the outer protective body and the connecting surface of the inner liner.

8. The safety helmet as claimed in claim 2, wherein the outer protective body and the inner liner both have multiple ball sockets facing the activity gap, and the ball sockets disposed on the outer protective body and the ball sockets disposed on the inner liner are arranged in an alternate manner; and the number of the at least one elastic ball is plural, and each one of the elastic balls is rollably disposed in a corresponding one of the ball sockets, and is rollably connected to one of the combining surface of the outer protective body and the connecting surface of the inner liner.

9. The safety helmet as claimed in claim 7, wherein the outer protective body has a shell and an outer liner, the outer liner is fixedly disposed on the shell and faces the inner liner, and the combining surface and the ball sockets are formed on the outer liner.

10. The safety helmet as claimed in claim 8, wherein the outer protective body has a shell and an outer liner, the outer liner is fixedly disposed on the shell and faces the inner liner, and the combining surface and the ball sockets are formed on the outer liner.

11. The safety helmet as claimed in claim 1, wherein the number of the at least one retaining element is plural, and each one of the retaining elements is a seat and has a ball socket formed on the seat and facing the activity gap; and the number of the at least one elastic ball is plural, and each one of the elastic balls is rollably disposed in the ball socket of a corresponding one of the retaining elements, and is rollably connected to one of the combining surface of the outer protective body and the connecting surface of the inner liner.

12. The safety helmet as claimed in claim 2, wherein the number of the at least one retaining element is plural, and each one of the retaining elements is a seat and has a ball socket formed on the seat and facing the activity gap; and the number of the at least one elastic ball is plural, and each one of the elastic balls is rollably disposed in the ball socket of a corresponding one of the retaining elements, and is rollably connected to one of the combining surface of the outer protective body and the connecting surface of the inner liner.

13. The safety helmet as claimed in claim 11, wherein the outer protective body has a shell, the combining surface is formed on an inner surface of the shell facing the inner liner, and the retaining elements disposed on the outer protective body are disposed on the combining surface.

14. The safety helmet as claimed in claim 12, wherein the outer protective body has a shell, the combining surface is formed on an inner surface of the shell facing the inner liner, and the retaining elements disposed on the outer protective body are disposed on the combining surface.

15. The safety helmet as claimed in claim 1, wherein the number of the at least one retaining element is plural, the outer protective body and the inner liner both have multiple said retaining elements, the retaining elements disposed on the outer protective body and retaining elements disposed on the inner liner are arranged in an alternate manner, and each one of the retaining elements has a ball socket formed thereon and facing the activity gap; and the number of the at least one elastic ball is plural, and each one of the elastic balls is rollably disposed in the ball socket of a corresponding one of the retaining elements, and is rollably connected to one of the combining surface of the outer protective body and the connecting surface of the inner liner.

16. The safety helmet as claimed in claim 2, wherein the number of the at least one retaining element is plural, the outer protective body and the inner liner both has multiple said retaining element, the retaining elements disposed on the outer protective body and the retaining elements disposed on the inner liner are arranged in an alternate manner, and each one of the retaining elements has a ball socket formed thereon and facing the activity gap; and the number of the at least one elastic ball is plural, and each one of the elastic balls is rollably disposed in the ball socket of a corresponding one of the retaining elements, and is rollably connected to one of the combining surface of the outer protective body and the connecting surface of the inner liner.

17. The safety helmet as claimed in claim 15, wherein the outer protective body has a shell and an outer liner, the outer liner is fixedly disposed on the shell and faces the inner liner, and the combining surface and the at least one retaining element are formed on the outer liner.

18. The safety helmet as claimed in claim 16, wherein the outer protective body has a shell and an outer liner, the outer liner is fixedly disposed on the shell and faces the inner liner, and the combining surface and the at least one retaining element are formed on the outer liner.

19. The safety helmet as claimed in claim 1, wherein the number of the at least one retaining element is plural, and each one of the retaining elements is a ring; and the number of the at least one elastic ball is plural, and each one of the elastic balls is rollably disposed in the ball socket of a corresponding one of the retaining elements, and is rollably connected to one of the combining surface of the outer protective body and the connecting surface of the inner liner.

20. The safety helmet as claimed in claim 19, wherein the outer protective body has a shell and an outer liner, the outer liner is fixedly disposed on the shell and faces the inner liner, and the combining surface and the at least one retaining element are formed on the outer liner.

* * * * *